US006785483B2

(12) United States Patent
Liu et al.

(10) Patent No.: US 6,785,483 B2
(45) Date of Patent: Aug. 31, 2004

(54) SYSTEMS AND METHODS INCORPORATING JOB SCHEDULING TO EXTEND THE LIFETIME OF AN INK SUMP

(75) Inventors: Chu-heng Liu, Penfield, NY (US); George A. Gibson, Fairport, NY (US); James R. Larson, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/321,928

(22) Filed: Dec. 17, 2002

(65) Prior Publication Data

US 2004/0114950 A1 Jun. 17, 2004

(51) Int. Cl.[7] ..... G03G 15/00; G03G 15/10

(52) U.S. Cl. ..... 399/57; 399/24; 399/237; 399/248

(58) Field of Search ..... 399/24, 27, 29, 399/30, 9, 53, 57, 82, 237, 248, 238; 347/6, 7, 19

(56) References Cited

U.S. PATENT DOCUMENTS

| | | | | | |
|---|---|---|---|---|---|
| 5,592,298 | A | * | 1/1997 | Caruso | 399/24 X |
| 6,374,065 | B1 | * | 4/2002 | Nishimura et al. | 399/53 |
| 6,510,303 | B2 | * | 1/2003 | Bessette | 399/53 X |
| 2003/0099477 | A1 | * | 5/2003 | Shimmura | 399/57 |

FOREIGN PATENT DOCUMENTS

| | | | |
|---|---|---|---|
| JP | 02-306275 | * | 12/1990 |

* cited by examiner

*Primary Examiner*—Sophia S. Chen

(57) ABSTRACT

Methods and system incorporating job scheduling to extend the lifetime of an ink sump according to one or more replenishment models in which two replenishing sumps are used to maintain compositional stability in a working ink sump operable in a three subcomponent ink replenishment system. Determinations of failure modes of the toner sump are made and basic principles for replenishment are presented for implementation in a control system operable to enhance ink sump performance and to extend the ink sump lifetime.

6 Claims, 2 Drawing Sheets

SYSTEMS AND METHODS INCORPORATING JOB SCHEDULING TO EXTEND THE LIFETIME OF AN INK SUMP

BACKGROUND OF THE INVENTION

The present Invention pertains to the art of printing systems and more particularly to liquid immersion development (LID) image reproduction systems.

Liquid immersion development image reproduction systems are well known, and generally each includes an image bearing member or photoreceptor having an image bearing surface on which latent images are formed and developed as single color or multiple color toner images for eventual transfer to a receiver substrate or copy sheet. Each such image reproduction system thus includes a development system or systems that each utilizes a liquid developer material (hereinafter, also described as "ink") typically having about 2 percent by weight of charged, solid particulate toner material of a particular color, that is dispersed at a desired concentration in a clear liquid carrier.

The latent images formed on the image bearing surface of the image bearing member or photoreceptor are developed with the charged toner particles, with excess liquid carrier being left behind or removed. The developed image or images on the image bearing member are then further conditioned and subsequently electrostatically transferred from the image bearing surface to an intermediate transfer member. Following that, the conditioned image or images are then hot or heat transferred from the intermediate transfer member, at a heated transfer or transfix nip, to an output image receiver substrate or copy sheet.

LID image reproduction systems conventionally include a print engine including ink applicator for supplying or applying an even layer of the ink for image development. A supply of ink is maintained in an ink sump which must be replenished to compensate for the consumption of toner components associated with printing. The composition of such ink typically includes ink subcomponents such as carrier fluid, toner particles and charge director. During printing, images developed in image areas will consume all three subcomponents at respective rates and development of non-image areas will consume these components at respectively different rates.

Replenishment of these subcomponents is required to maintain compositional stability of the ink, which is a prerequisite for stable printing performance. Due to the multiple component nature of the ink, and due to the different consumption rates for each of the subcomponents, the design and operation of the particular scheme chosen for replenishing such components will affect the performance and lifetime of the ink sump.

There is therefore a need for a method and system for LID image reproduction which operates an ink sump, wherein there is improved ink replenishment so as to extend the performance and lifetime of the ink sump.

SUMMARY OF THE INVENTION

Due to the multiple component nature of the ink in a LID image reproduction system, and due to the different consumption rates for each of the subcomponents, the design and operation of the particular scheme chosen for replenishing such components will affect the performance and lifetime of the ink sump. For example, a scheme of constant composition replenishment is not sufficient, to guarantee constant imaging performance. The attainment of chemical equilibrium (or at least chemical steady state) among the subcomponents is generally required as well. Phenomena, such as add-mix failure, are the undesired consequence of failure to attain the required chemical equilibrium. For a system with slow kinetics, the dynamics of ink replenishing is complicated. Not only the printing sequence, but also the printing rate and the time interval between prints will have significant impact on the ink sump performance. In this invention, an ink replenishment system and methods are described in which the time required for attainment of the chemical equilibrium is much faster than any other time scale that is relevant to the printing and replenishing subsystems.

It is easily seen that if each ink subcomponent is replenished independently, then compositional stability can be obtained. If such a printing system is restricted to replenish from only two sources, as Is the case in many common printers, compositional control may well be lost. Factors that will help to determine the rate of loss of compositional control include the consumption of various components include factors primarily dependent on the fluctuation in the consumption rate.

When printing at a fixed image coverage document, the consumption of each toner component will be fixed and given by the weighted sum of image and background consumption. A simplifying assumption may be made to neglect the effects of certain image features (e.g. lines or dots) on ink consumption.

A fixed replenishing rate of the various components can be sufficient to maintain the compositional balance of the ink in such a fixed image coverage system. That is, it is possible to find a replenishment ratio which will maintain a working ink sump composition indefinitely as long as a fixed image is printed.

It is desirable, however, to derive a replenishment ratio for a three-subcomponent Ink sump replenishment system operable in an Image reproduction system for printing documents of widely varying image content.

In accordance with the present invention, there is provided in an electrostatographic liquid immersion development (LID) image system for printing documents of widely varying image content wherein there is improved replenishment of plural ink subcomponents.

Presented herein is an ink replenishment model in which only two replenishing sumps are needed to maintain compositional stability in a working ink sump operable in such a three subcomponent ink replenishment system. Determinations of failure modes of the toner sump are made and basic principles for replenishment are presented to enhance the ink sump performance and to extend the ink sump lifetime.

In accordance with one aspect of the present invention, an electrostatographic liquid immersion development (LID) imaging system includes an automated scheduling of a plurality of print jobs of various or varying characteristics according to one or more job scheduling criteria determinable so as to extend the ink sump lifetime.

Further advantages will become apparent to one of ordinary skill in the art upon a reading and understanding of the subject specification.

BRIEF DESCRIPTION OF THE DRAWINGS

The invention may take physical form in certain parts, and arrangements of parts, a preferred embodiment of which will be described in detail in this specification and illustrated in the accompanying drawings which form a part hereof, and wherein.

DETAILED DESCRIPTION OF THE PREFERRED EMBODIMENTS

Definition of Terms

Figure 1:
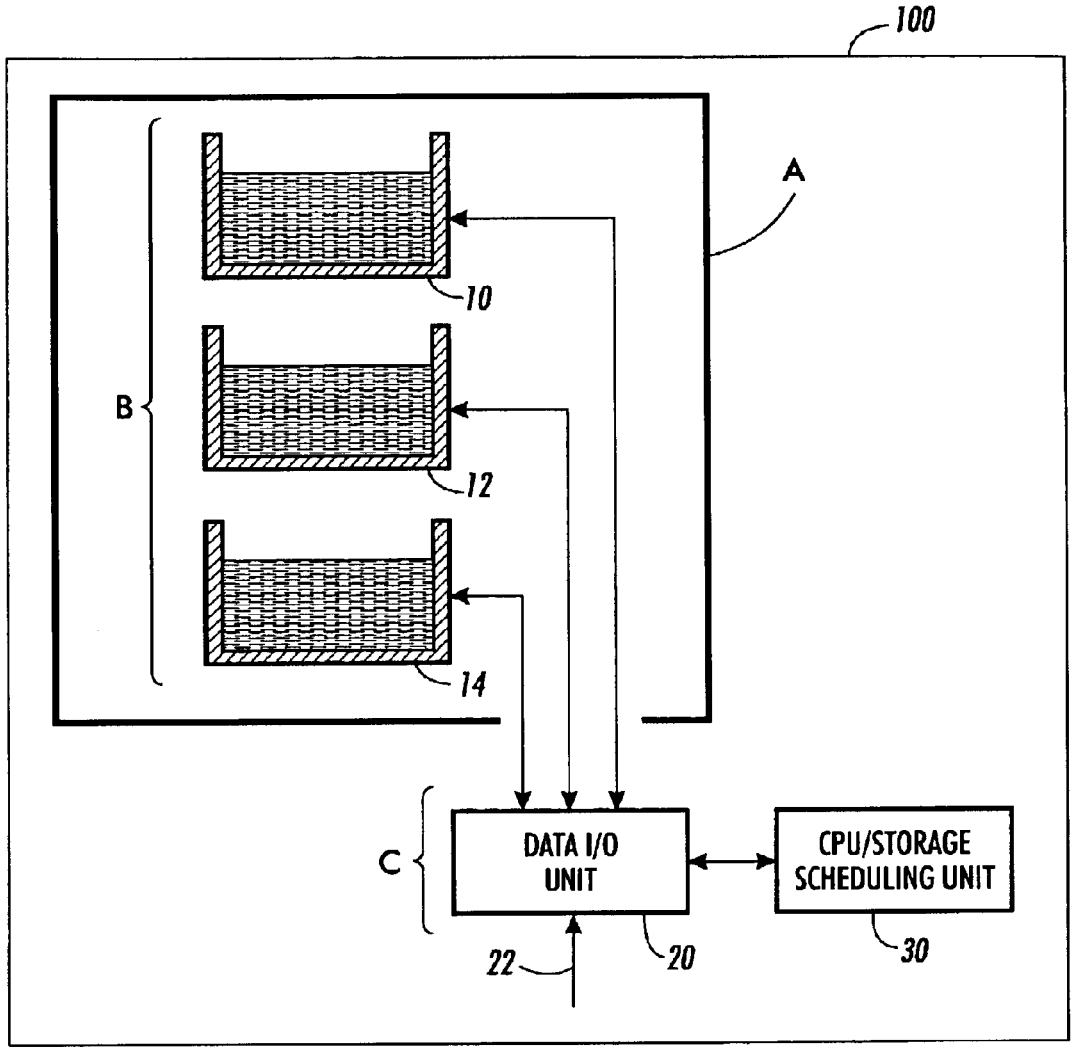
FIG. 1 provides a schematic of a representative an electrostatographic liquid immersion development (LID) imaging system incorporating, according to the present Invention, automated job scheduling to extend the lifetime of one or more ink sump units operable therein.

The present invention may be understood according to the following definitions of terms:

Printing Coverage: the percent of solid area (i.e., image area) for a print page.

Standard (or Average) Coverage: the % coverage of image area for a typical (or average) print. This factor may be used to select the optimal ratio of charge director (CD) to solid (S), that is, CD/S of the concentrate.

Optimal CD/S Ratio: the optimized CD/S ratio of a concentrate (for example, when optimized for the average coverage).

Sump State: the state of a sump. It can be defined by the amount of solid (S), charge director (CD), and fluid (F) therein; or by the amount of solid, CD, and Total Volume. The performance of an ink is usually determined by two parameters: the concentrations of solid (toner) and charge director (CD).

High/Low Coverage Print, or Overprint(Underprint Page: a print that exhibits higher/lower coverage than the standard coverage.

Overprinted or Underprinted State: the state of a sump resulting from printing of respectively high or low coverage pages.

Safe Operation Range: the range of solid (S) and/or charge director (CD) within which the performance of the ink sump is acceptable. In the models described herein, it is the range of levels of solid or charge director within which the performance of the ink sump is acceptable, assuming those levels are held constant.

Marginal State: the sump state that is pertinent to the boundary of the safe operation range. Any high/low coverage print (as there Is about 50% probability for each) can cause the state of the sump to move out of its operation range, thus leading to the end of the sump life. The ink in the sump will either perform unacceptably or need attention.

Operational Tolerance: (also see safe operation range defined above), the upper and lower allowed deviation from the optimal working sump state (relevant to concentrations of solid and charge director). For example: in one ink replenishment scheme, one may maintain the level of charge director (CD), and the level of solid (S) can vary from (S)– to (S)+.

Overprinting/Underprinting Compliance: With (or without) a pre-determined scheme for replenishing, a working sump can maintain its printing quality for only a limited accumulative number of overprint/underprint jobs. This limit is the overprint/underprint compliance. One preferred way to define this compliance:

Overprinting Compliance: Area (pages) of 100% coverage continuous printing before the sump fails.

Underprinting Compliance: Area (pages) of 0% coverage continuous printing before the sump fails.

Accumulative Printing Deviation: Sump state expressed in term of the net area of overprinting/overprinting. A positive value indicates overprinting and a negative value indicates underprinting. The accumulative printing deviation can be used to monitor the life expectancy and the stability of the sump by simply comparing the accumulative printing deviation with the overprint/underprint compliance of the sump. A calculation of accumulative printing deviation may be as follows:

Accumulative Printing Deviation=total image area printed−(standard coverage)(total area printed)

Turning now to the drawings wherein the purpose is for illustrating the preferred embodiment of the invention only, and not for the purpose of limiting the same, FIG. 1 illustrates an embodiment of the subject invention in a LID-based image reproduction system 100 having a print engine A which includes a plurality of sump units B and a control system unit C for performing system configuration and job scheduling. As used herein, "print engine" refers in particular to a LID-based print engine operable in any suitable reprographic machine, such as a printer, copier, facsimile machine, and the like.

Given a document to be printed on a given print engine, job scheduling is provided which serves to identify, schedule, and initiate system operations for producing a document. Such operations may include feeding of sheets, moving of sheets, preparation of images, transferring of images to sheets, etc. As a consequence, machine-specific and sump-unit-specific information may be used by the control system unit C such that the control system unit C is able to determine and carry out which operations will produce the desired ink sump conditioning and/or replenishment. Further, the system can monitor certain machine-specific or operator-inputted constraints which must be observed when performing job scheduling of such operations. Additionally, the system is provided with a means by which it may send appropriate commands to the print engine A and other machine subsystems (not shown) to allow them to accomplish their available functions.

Operation of system 100 for implementing one or more operations which extend the lifetime of one or more of the sump units B is modeled as will be described in detail below, in that various aspects of each of the operation of sump units B are monitored, ascertained, and correlated in the data processor unit C. Such correlated and analyzed data is further analyzed In view of operator Inputs provided on incoming data line 22 defining, for example, a desired printer operation, or series of operations, and especially for data relevant to print job scheduling. This, in turn, is used to optimize, schedule, and control operation of the system 100 to most efficiently accomplish the series of printing tasks while adhering to the job scheduling criteria as are described herein. The subject system is described by way of example with a reprographic system. It will be appreciated that the criteria described herein for job scheduling may be practicable on any printing system that employs one or more LID-based print engines.

With the particular example of FIG. 1, the units B are illustrated as including a carrier fluid sump 10, a concentrated ink sump 12, and a working ink sump 14. Turning to the data processor unit C, included therein is a data input/output ("I/O") unit 20 which is in data communication with a central processor unit ("CPU")/storage scheduling unit 30, the details of which will be described further below. A data path is provided between the data I/O unit 20 and each of the ink sump units B.

In the preferred embodiment, each sump unit B is known to the data processor unit C having therein a description of operational parameters and other information associated with various functions and capabilities of each ink sump unit B. The particulars of such a description will be detailed below. The data path between each of the illustrated ink sump units and the data I/O unit allows for acquisition to the data processor unit C of all such description. In the preferred embodiment, any ink sump unit B will communicate its associated condition to the data I/O unit.

Data interconnections between the data I/O unit 20 of the data processor C and the various sump units B also allow for controlled activation thereof. Thus, the data processor unit C may ascertain from the available sump units B parameters relevant to the complete set of capabilities of the print engine A. This information, coupled with user input 22 to the data I/O unit 20 allows for improved scheduling of not only print job production, but also of the efficient replenishment of Ink subcomponent resources, so as to accomplish an extended ink sump lifetime by Implementation of the teachings herein.

The system 100 allows for automated scheduling of print jobs pursuant to the capabilities associated with the illustrated sump units B operable in the print engine A, and will be described with particular reference thereto. However, it will be appreciated that the invention has broader application, such as in providing for an automated conditioning and/or remediation of the illustrated sump units B in view of varying job specific demands on the print engine, and for application of appropriate job scheduling criteria in an efficient manner.

Hence, the system is also readily adaptable to a real-time, reactive environment wherein resources for ink sump replenishment may become unavailable or restricted to a subset of their normal capacity.

In the following discussion, a three subcomponent ink replenishment model is used. Some or all aspects of the following model may be employed in an adaptive control system implemented according to techniques known In the art by the control system unit 30, such as may be Implemented according to program control code which dynamically adapts the behavior of the print engine A to reflect a current situation, and such implementation can be suitably extended even further If a print job schedule is changed, or according to certain resource constraints, and so on.

Accordingly, the LID-based image reproduction system 100 is operable according to at least one of the improved ink replenishment schemes described herein so as to extend the performance and lifetime of one or more of the sump units B, and in particular to extend the lifetime of the working ink sump 14.

Figure 2:
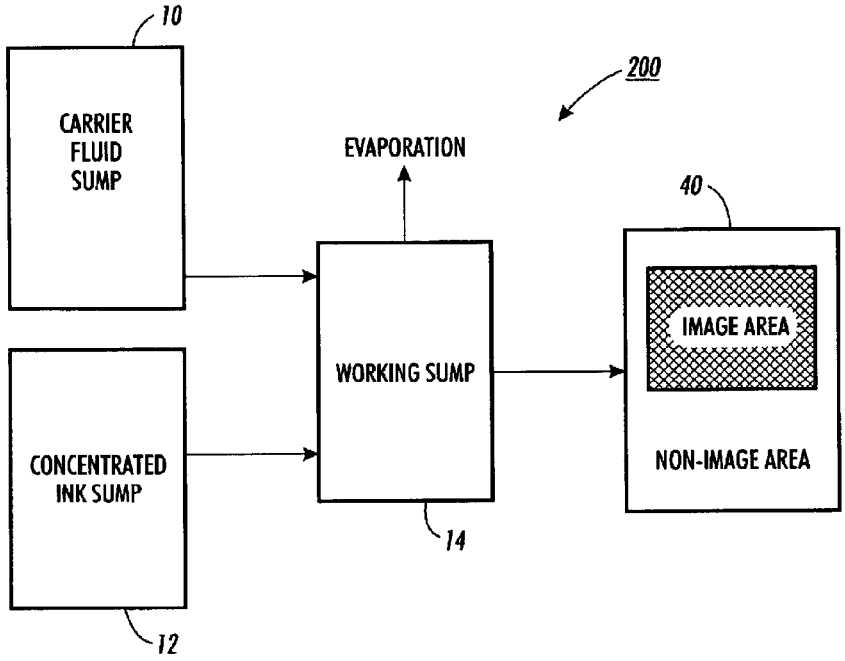
FIG. 2 is a block diagram depicting the operation of the ink sump units of FIG. 1.

Turning now to FIG. 2, models for replenishment of the working ink sump 14 of FIG. 1 will be understood with reference to a ink sump system 200, wherein there is controlled provision of carrier fluid from a carrier fluid sump unit 10 to the working ink sump unit 14 and controlled provision of ink subcomponents (toner, charge director (CD), and carrier fluid) also to the working ink sump unit 14. Ink is consumed from the working ink sump unit 14 for production of a reproduced image on image receivers 40 having toner deposited thereon according to imagewise patterns of image and non-image areas. Models useful for improved operation of the system 200, and in particular for determining useful criteria for performing job scheduling to extend the lifetime of one or more of the ink sump units in the system 100, will now be described.

Mass Conservation in the Toner

The ink in the working ink sump 14 is considered herein as a blended mixture of three subcomponents: carrier fluid, toner, and charge director (CD). Quantities of these three subcomponents are present In the working ink sump and are consumed due to print jobs, and the working ink sump 14 is typically replenished with both concentrated ink and carrier fluid. The toner consumption can be expressed as:

$$-\frac{d}{dt}(C_S V) = PIS_I + P(1-I)S_{NI} - k_{con}C_{consS}$$

where:

P: printing rate (area/time)

V: sump volume

I: image coverage (%)

$k_{con}$: replenishing rate of concentrated ink $C_S$: solid concentration of the working ink sump $S_I$, $S_{NI}$: solid content of image (non-image) area (mass/area)

$C_{consS}$: solid concentration of the concentrated ink sump $C_{CD}$: CD concentration of the working ink sump $CD_I$, $CD_{NI}$: CD content of image (non-image) area (mass/area)

$C_{conCD}$: CD concentration of the concentrated ink sump $F_I$, $F_{NI}$: fluid content of image (non-image) area (mass/area)

$k_{fluid}$: replenishing rate of fluid $k_{eva}$: evaporation rate of fluid

Similarly, charge director (CD) is consumed in both image and non-image areas and is replenished from the concentrate, the process which can be expressed as:

$$-\frac{d}{dt}(C_{CD}V) = PICD_I + P(1-I)CD_{NI} - k_{con}C_{conCD}$$

Finally, carrier fluid is consumed in image and non-image areas and by evaporation. It is replenished from the carrier fluid sump 10 and also from the concentrated ink sump 12.

$$-\frac{d}{dt}[(1-C_S-C_{CD})V] = PIF_I + P(1-I)F_{NI} - k_{fluid} + k_{eva} - k_{con}(1-C_{consS}-C_{conCD})$$

Non-tolerant Ink Subcomponent Replenishment Model

In this section, we analyze a first replenishment scheme for an ink sump system that cannot tolerate even minor fluctuations in the masses of charge director, toner, and carrier fluid in the working ink sump 14. This requirement for exact compositional stability can be expressed as:

$$\frac{d}{dt}(C_S V) = \frac{d}{dt}(C_{CD}V) = \frac{d}{dt}V = 0$$

A key issue in the solution of this model will be the determination of the charge director to solid toner mass ratio in the concentrate. In general, this ratio is different from that in the working ink sump. The charge director to solid toner mass ratio in the concentrate should be the ratio of the charge director and solid toner at which they are consumed during the printing.

$$\frac{C_{consS}}{C_{conCD}} = \frac{PIS_I + P(1-I)S_{NI}}{PICD_I + P(1-I)CD_{NI}}$$

It is shown therefore, that, with a fixed $C_{consS}/C_{conCD}$, this simple replenishment scheme can only maintain constant masses of toner, charge director, and fluid at one image coverage I. Variation of printing coverage will destroy the above-described balance of CD, toner, and fluid in the working Ink sump. Accordingly, this replenishing system would not be suitable for an ink sump system 200 that employs working ink sump 14 requiring an exact balance of CD and toner.

Robust Ink Subcomponent Replenishment Model

In this section, we analyze a second ink replenishment scheme that has been found to tolerate some fluctuations in the masses of CD, toner, and carrier fluid maintained in the working ink sump 14. This model is more consistent with the operation of a practical ink sump system that employs conventional ink formulations. To a certain extent, the breadth of the compositional latitudes considered in the following discussion can be taken as a Figure of Merit of a toner. As was previously discussed, the control system unit 30 in the image reproduction system 100 is cognizant of job scheduling information that indicates the present and near future job stream demands on the system. Accordingly, a target average area of coverage for a job stream is determinable and two different aspects of latitude may be modeled.

Basic Replenishing Scheme 1: Charge director concentration is allowed to change within a predefined limit.

The operational constraints on the image reproduction system become:

a. Select $C_{conS}/C_{conCD}$ for the average image coverage $I_{av}$ using the procedure detailed in the previous section.

b. Maintain constant toner and fluid masses.

c. Allow charge director concentration in the working ink sump to vary within a certain tolerance $DC_{CD}$.

Basic Replenishing Scheme 2: Toner concentration is allowed to change within a predefined limit.

The operational constraints on the image reproduction system become:

a. Select $C_{conS}/C_{conCD}$ for the average Image coverage $I_{av}$ using the procedure detailed in the previous section.

b. Maintain constant CD and fluid masses; allow toner concentration in the working Ink sump to vary within a predetermined tolerance $DC_S$.

Determination of Solutions for Basic Replenishing Scheme 1

We can determine the solutions for basic replenishing scheme 1 as will now be shown. The solutions and discussions that follow will also apply to Basic Replenishing Scheme 2 by simply exchanging the symbols for toner with charge director (i.e., exchange S and CD in all the symbols in the equations). The important quantities here are the charge director to toner ratio in the concentrated ink sump 12 and the charge director concentration variation in the working ink sump 14 as a function of sump volume and printing coverage. Accordingly, $$\frac{C_{conS}}{C_{conCD}} = \frac{P\bar{I}S_I + P(1-\bar{I})S_{NI}}{P\bar{I}CD_1 + P(1-\bar{I})CD_{NI}}$$

$$\delta C_{CD} = -\frac{P}{V}\beta_{CD}\delta It$$

$$\beta_{CD} = \frac{S_{NI}CD_I - S_I CD_{NI}}{\bar{I}S_I + (1-\bar{I})S_{NI}}$$

$$\delta I = I - \bar{I}$$

It can be seen, therefore, that the demands of differing amounts of print coverage will cause the charge director concentration to change with different demand rates. Overprinting (i.e., wherein printing coverage is greater than the average coverage) and underprinting (wherein printing coverage is lower than the average coverage) will have opposing effects on the charge director concentration.

Modeling Sump Lifetime According to a Constant Printing Deviation from the Average Image Coverage At a constant printing deviation, the Charge Director concentration deviation will be linear with printing. The time at which the charge director concentration exceeds the limit will be:

$$\tau = \frac{\Delta C_{CD} V}{|P\beta_{CD}\delta I|}$$

This expression also reveals the functional dependence of the sump life on the sump volume.

Sump Lifetime Estimation with Fluctuating Image Coverage Deviation

In practical printing situations, the coverage of jobs will fluctuate and there is likely to be print jobs that cause significant overprinting and other print jobs that cause significant underprinting. The exact effect of a printing run on the toner sump composition will then depend on the exact nature of the job stream. One approximation will prove illustrative, however. We assume that the print jobs are randomly distributed with respect to the area of coverage. In this case, the charge director concentration deviation will follow the same random statistics. If the correlation between printing jobs is much shorter than the lifetime of the sump, the total deviation in composition will be proportional to the square root of the total print volume:

$$\delta C_{CD} = \frac{1}{V}\beta_{CD}\delta I_{job} P t_{job}\sqrt{\frac{t}{t_{job}}}$$

$$\tau = \left(\frac{\Delta C_{CD} V}{\beta_{CD}\delta I_{job} P t_{job}}\right)^2 t_{job}$$

Conclusions

According to the models shown herein, we have determined that implementation of large sump volumes and short printing jobs can increase the lifetime of the working ink sump 14. Extended life of the working ink sump may therefore be achieved by active job scheduling in the high volume printing situations for which it is feasible to perform job scheduling according to such criteria.

Furthermore, the foregoing analysis illustrates an opportunity to remediate the damage to the compositional stability of an ink sump 14 that may have been caused by an overprinting or an underprinting condition. To do so, a record is kept of the deviation from average print area sustained by a given sump unit. Then, a series of sustained, sacrificial print jobs can be performed that will condition the sump and therefore extend the lifetime of the respective sump. Such remedial job scheduling, when performed at sufficiently regular intervals, is expected to require a respective amount of waste disposal that is significantly less costly than the total cost of materials, waste disposal, and downtime required for a complete sump unit replacement.

What is claimed is:

1. In a liquid immersion development (LID) image reproduction system, a method of extending the lifetime of an ink sump unit, the method comprising the steps of:

(a) providing a large sump volume in the ink sump unit;

(b) performing print job scheduling so as to extend the lifetime of the ink sump unit; and (c) performing a series of print jobs, each of which having a duration less than a predetermined criterion.

2. The method of claim 1, wherein the one or more job scheduling criteria include at least one of:

a. a ratio of charge director to toner; and b. a variation of charge director concentration as a function of the sump volume and a printing coverage.

3. The method of claim 1, further comprising the steps of:

a. selecting a ratio of $C_{conS}/C_{conCD}$ for an average image coverage $I_{av}$;

b. maintaining constant toner and fluid masses; and c. allowing charge director concentration to vary within a certain tolerance $DC_{CD}$;

wherein:

$I_{av}$=average image coverage, $C_{conS}$=solid concentration of a concentrated ink sump, $C_{conCD}$=charge director concentration of a concentrated ink sump, $DC_{CD}$=director concentration variance.

4. The method of claim 1, further comprising the steps of:

a. selecting a ratio of $C_{conS}/C_{conCD}$ for an average image coverage $I_{av}$;

b. maintaining constant toner and fluid masses; and allowing toner concentration in the working ink sump to vary within a predetermined tolerance $DC_S$;

wherein:

$I_{av}$=average image coverage, $C_{conS}$=solid concentration of a concentrated ink sump, $C_{conCD}$=charge director concentration of a concentrated ink sump, $DC_S$=toner concentration variance.

5. In a liquid immersion development (LID) image reproduction system, a method of restoring the compositional stability of an ink sump unit, the method comprising the steps of:

(a) recording the deviation from average print area sustained by the ink sump unit;

(b) determining a level of recorded deviation indicative of an impaired compositional stability of the ink sump unit; and (c) responsive to step (b), performing print job scheduling so as to perform a series of sacrificial print jobs each of which having a duration less than a predetermined criterion.

6. An electrostatographic imaging system, comprising:

a print engine employing an ink sump having a large sump volume in the ink sump, operable according to a liquid immersion development (LID) process for performing a series of print jobs, each of which having a duration less than a predetermined criterion; and a control system for performing automated scheduling of a plurality of print jobs of varying characteristics according to one or more job scheduling criteria determinable for extending the lifetime of the ink sump, the control system being operable for performing print job scheduling so as to extend the lifetime of the ink sump unit.

* * * * *